US005607906A

United States Patent [19]

Okaniwa et al.

[11] Patent Number: 5,607,906

[45] Date of Patent: Mar. 4, 1997

[54] GREASE COMPOSITION FOR CONSTANT VELOCITY JOINTS

[75] Inventors: Takashi Okaniwa; Hisayuki Osawa, both of Fujisawa, Japan

[73] Assignee: Kyodo Yushi Co., Ltd., Tokyo, Japan

[21] Appl. No.: 635,673

[22] Filed: Apr. 22, 1996

[30] Foreign Application Priority Data

Nov. 13, 1995 [JP] Japan ..... 7-294251
Nov. 29, 1995 [JP] Japan ..... 7-310531

[51] Int. Cl.[6] ..... C10M 115/08; C10M 125/22

[52] U.S. Cl. ..... 508/168; 508/167; 508/169; 508/321; 508/379; 508/363; 508/390; 508/391; 508/460; 508/525; 508/552; 508/586

[58] Field of Search ..... 508/552, 167, 508/168, 169

[56] References Cited

U.S. PATENT DOCUMENTS

| | | | |
|---|---|---|---|
| 3,095,375 | 6/1963 | Pitman | 508/147 |
| 3,127,347 | 3/1964 | Franz | 508/552 |
| 3,223,624 | 12/1965 | Morway et al. | 508/164 |
| 3,284,357 | 11/1966 | Koandakjian | 508/552 |
| 3,563,894 | 2/1971 | Christian | 508/552 |
| 3,730,895 | 5/1973 | Kjonaas | 508/176 |
| 3,840,463 | 10/1974 | Froeschmann et al. | 508/161 |
| 3,844,955 | 10/1974 | Green | 508/169 |
| 4,536,308 | 8/1985 | Pehler et al. | 508/335 |
| 4,759,859 | 7/1988 | Waynick | 508/159 |
| 4,787,992 | 11/1988 | Waynick | 508/163 |
| 4,830,767 | 5/1989 | Waynick | 508/163 |
| 4,840,740 | 6/1989 | Sato et al. | 508/364 |
| 4,902,435 | 2/1990 | Waynick | 508/163 |
| 5,059,336 | 10/1991 | Naka et al. | 508/552 |
| 5,084,193 | 1/1992 | Waynick | 508/552 |
| 5,126,062 | 6/1992 | Barnes | 508/163 |
| 5,160,645 | 11/1992 | Okaniwa et al. | 508/356 |
| 5,207,936 | 5/1993 | Anzai et al. | 508/168 |
| 5,449,471 | 9/1995 | Ozaki et al. | 508/438 |
| 5,498,357 | 3/1996 | Naka et al. | 508/552 |

FOREIGN PATENT DOCUMENTS

| | | |
|---|---|---|
| 0508115 | 10/1992 | European Pat. Off. . |
| 62-207397 | 9/1987 | Japan . |
| WO94/11470 | 5/1994 | WIPO . |
| WO96/02615 | 2/1996 | WIPO . |

*Primary Examiner*—Ellen M. McAvoy
*Attorney, Agent, or Firm*—Oblon, Spivak, McClelland, Maier & Neustadt, P.C.

[57] ABSTRACT

A grease composition for constant velocity joints which consists essentially of: (a) a base oil; (b) an urea thickener; (c) molybdenum disulfide; and (d) a metal salt or an overbasic metal salt selected from the group consisting of metal salts or overbasic metal salts of oxidized waxes, petroleum sulfonates, alkyl aryl sulfonates, salicylate, and phenates. In addition to (a) to (d), it may further contain, (e) an extreme pressure agent selected from the group consisting of a metal-free sulfur-phosphorus extreme pressure agent and molybdenum dithiophosphate, or (f) molybdenum dithiocarbamate. The grease composition exhibits excellent wear-resistance and pitting-inhibitory effect.

12 Claims, No Drawings

GREASE COMPOSITION FOR CONSTANT VELOCITY JOINTS

BACKGROUND OF THE INVENTION

The present invention relates to a grease composition for use in constant velocity joints, in particular, for ball type fixed and plunging constant velocity joints. A very high contact pressure is developed between the parts of the constant velocity joints to be lubricated and the joint parts undergo complicated rolling and sliding motions. This often results in abnormal wear and metal fatigue and, in turn, leads to a spalling phenomenon, i.e., pitting of the joint parts. More specifically, the present invention relates to a grease composition for constant velocity joints which can effectively lubricate such constant velocity joints to effectively reduce the wear of joints and to effectively reduce the occurrence of any pitting of the parts.

Examples of lubricating greases conventionally used in such constant velocity joints include a lithium soap thickened extreme pressure grease containing molybdenum disulfide and a lithium soap thickened extreme pressure grease containing molybdenum disulfide and extreme pressure agents, e.g., sulfur-phosphorus or a lead naphthenate. However, these greases for constant velocity joints have not always been satisfactory in the severe working conditions which occur in the present high-performance motorcars.

The double offset type constant velocity joints and cross groove type constant velocity joints used as the plunging joints as well as Birfield joints used as the fixed joints have a structure in which torques are transmitted through 6 balls. These joints cause complicated reciprocating motions such as complicated rolling and sliding motions during rotation under a high contact pressure, stresses are repeatedly applied to the balls and the metal surfaces which come in contact with the balls and accordingly, the pitting phenomenon is apt to occur at such portions due to metal fatigue. The recent improvement in the power of engines is accompanied by an increase in the contact pressure as compared with conventional engines. Motorcars are being made lighter to improve fuel consumption and the size of joints has correspondingly been down-sized. This leads to a relative increase in the contact pressure and thus the conventional greases are ineffective in that they cannot sufficiently reduce the pitting phenomenon. In addition, the greases must also be improved in their heat resistance.

SUMMARY OF THE INVENTION

Accordingly, an object of the present invention is to provide a novel grease composition for constant velocity joints which has an excellent pitting-inhibitory effect and heat resistance.

The inventors of this invention have conducted various studies to develop a grease composition capable of optimizing the frictional wear of the constant velocity joints and of eliminating the problem of pitting of joints due to abnormal wear and metal fatigue and having improved heat resistance. The inventors have carried out a quality evaluation of greases used under lubricating conditions which are accompanied by complicated reciprocating motions such as complicated rolling and sliding motions under a high contact pressure as has been discussed above using an SRV (Schwingung Reibung und Verschleiss) tester known as an oscillating friction and wear tester, to determine lubricating characteristics (such as friction coefficient and wear) of various kinds of extreme pressure agents, solid lubricants or combinations of additives. As a result, the inventors have found that a grease consisting essentially of a specific combination of a base oil; an urea thickener; molybdenum disulfide; a metal salt or an overbasic metal salt of a specific compound; a grease consisting essentially of the specific combination mentioned above and an extreme pressure agent selected from the group consisting of a metal-free sulfur-phosphorus extreme pressure agent and molybdenum dithiophosphate; or a grease consisting essentially of the specific combination mentioned above and molybdenum dithiocarbamate exhibits desired lubricating characteristics such as a good friction coefficient and low wear and have confirmed, by a durability test performed using a practical constant velocity joint, that the grease can prevent the occurrence of any pitting phenomena, unlike the conventional greases for constant velocity joints and thus have completed the present invention.

The foregoing object of the present invention can effectively be accomplished by providing a grease composition for constant velocity joints which consists essentially of:

(a) a base oil;

(b) an urea thickener;

(c) molybdenum disulfide; and (d) a metal salt or an overbasic metal salt selected from the group consisting of metal salts of oxidized waxes, metal salts of petroleum sulfonates, metal salts of alkyl aryl sulfonates, metal salts of salicylate, metal salts of phenates, overbasic metal salts of oxidized waxes, overbasic metal salts of petroleum sulfonates, overbasic metal salts of alkyl aryl sulfonates, overbasic metal salts of salicylate, and overbasic metal salts of phenates.

The grease composition of a preferred embodiment of the present invention comprises further (e) an extreme pressure agent selected from the group consisting of a metal-free sulfur-phosphorus extreme pressure agent and molybdenum dithiophosphate in addition to the components (a) to (d).

The grease composition of another preferred embodiment of the present invention comprises further (f) molybdenum dithiocarbamate in addition to the components (a) to (d).

The grease composition of further preferred embodiment of the present invention may comprise (e) an extreme pressure agent selected from the group consisting of a metal-free sulfur-phosphorus extreme pressure agent and molybdenum dithiophosphate and (f) molybdenum dithiocarbamate in addition to the components (a) to (d), provided that the metal salt or the overbasic metal salt of the component (d) is selected from the group consisting of salts of magnesium, barium, sodium, potassium, lead, zinc, and aluminum.

DESCRIPTION OF THE PREFERRED EMBODIMENTS

The present invention will hereunder be explained in more detail.

The base oil as Component (a) is not restricted to specific ones and may be, for instance, lubricating oils currently used such as mineral oils, ester type synthetic oils, ether type synthetic oils, hydrocarbon type synthetic oils or mixture thereof.

The urea thickener as Component (b) is not restricted to specific ones and may be, for instance, diurea compounds and polyurea compounds.

Examples of the diurea compounds include those obtained through a reaction of a monoamine with a diisocyanate compound. Examples of the diisocyanates include phenylene diisocyanate, diphenyl diisocyanate, phenyl diisocyanate, diphenylmethane diisocyanate, octadecane diisocyanate, decane diisocyanate, and hexane diisocyanate. Examples of the monoamines include octylamine, dodecylamine, hexadecylamine, octadecylamine, oleylamine, aniline, p-toluidine, and cyclohexylamine.

Examples of the polyurea compounds include those obtained through a reaction of a diamine with a diisocyanate compound. Examples of the diisocyanates include those used for the formation of the diurea compounds as mentioned above. Examples of the diamines include ethylenediamine, propanediamine, butanediamine, hexanediamine, octanediamine, phenylenediamine, tolylenediamine, and xylenediamine.

Preferred examples of urea thickeners include those obtained through a reaction of aryl amine such as aniline or p-toluidine, cyclohexyl amine or a mixture thereof with a diisocyante. The aryl group in the diurea compounds is preferably those having 6 or 7 carbon atoms and the rate of the aryl group in the diurea compound ranges from 100 to 0 mole% based on the total moles of the aryl and the cyclohexyl groups in the diurea compounds.

The molybdenum disulfide as Component (c) has widely been used as an extreme pressure agent. With regard to the lubricating mechanism thereof, the molybdenum disulfide is easily sheared under the sliding motions through the formation of a thin layer since it has a layer lattice structure and it shows effects of reducing the frictional force and of preventing seizure of joints. There have been known molybdenum disulfide products having various particle sizes, but it is preferable, in the present invention, to use those having a particle size ranging from 0.25 to 10 μm expressed in terms of an average particle size as determined by the method called Fisher method (by the use of a Fisher Sub-Sieve sizer), in particular, those having an average particle size of 0.55 to 0.85 μm.

The metal salts or overbasic metal salts as Component (d) are selected from those known as metal cleaning dispersants or rust-inhibitors which are used in lubricants such as engine oils, such as metal salts of oxidized waxes, metal salts of petroleum sulfonates which are obtained by the sulfonation of aromatic hydrocarbon in lubricating oil fraction, metal salts of synthetic sulfonates such as dinonylnaphthalene sulfonic acid and alkylbenzene sulfonic acid, metal salts of salicylate, metal salts of phenates, overbasic metal salts of oxidized waxes, overbasic metal salts of petroleum sulfonates, overbasic metal salts of alkyl aryl sulfonates, overbasic metal salts of salicylate, and overbasic metal salts of phenates.

Preferred examples of metals of the metal salts or overbasic metal salts as Component (d) include calcium, magnesium, barium, sodium, potassium, lead, zinc, and aluminum, in particular calcium and sodium.

Preferred metal-free sulfur-phosphorus extreme pressure agents as Component (e) have a sulfur content ranging from 15 to 35% by weight and a phosphorus content ranging from 0.5 to 3% by weight and exhibits excellent effects of inhibiting wear and of preventing seizure of the joints through the well-established balance between the sulfur and phosphorus contents. More specifically, if the sulfur content exceeds the upper limit defined above, joints are easily corroded, while if the phosphorus content exceeds the upper limit defined above, any wear-inhibitory effect cannot be expected. On the other hand, if the sulfur and phosphorus contents are both less than the corresponding lower limits, any desired effect of the present invention cannot likewise be expected.

As an extreme pressure agent (Component (e)), molybdenum dithiophosphates can also be used. Preferred molybdenum dithiophosphates is represented by the following formula (1):

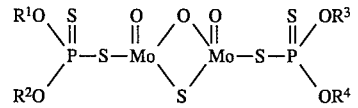

wherein $R^1$, $R^2$, $R^3$ and independently represent primary or secondary alkyl group having 1 to 24, preferably 3 to 20 carbon atoms, or aryl group having 6 to 30, preferably 8 to 18 carbon atoms.

The molybdenum dithiocarbamate as Component (f) is preferably represented by the following formula:

$$(R^5R^6N—CS—S)_2—MO^2OmSn$$

wherein $R^5$ and $R^6$ independently represent an alkyl group having 1 to 24 carbon atoms, preferably 3 to 18 carbon atoms, m is 0 to 3, n is 4 to 1 and m +n=4.

The grease composition for constant velocity joints of the invention may further comprise antioxidants, corrosion inhibitors, rust inhibitors in addition to the foregoing essential components.

The grease composition of a first preferred embodiment of the invention consists essentially of, on the basis of the total weight of the composition, 55.0 to 98.0% by weight of the base oil (a); 1 to 25% by weight of the urea thickener (b); 0.5 to 5.0% by weight of the molybdenum disulfide (c); and 0.5 to 15% by weight of the metal salt or overbasic metal salt (d).

The grease composition of a second preferred embodiment of the invention consists essentially of, on the basis of the total weight of the composition, 52.0 to 97.9% by weight of the base oil (a); 1 to 25% by weight of the urea thickener (b); 0.5 to 5.0% by weight of the molybdenum disulfide (c); 0.5 to 15% by weight of the metal salt or overbasic metal salt (d); and 0.1 to 3% by weight of the extreme pressure agent selected from the group consisting of a metal-free sulfur-phosphorus extreme pressure agent and molybdenum dithiophosphate (e).

The grease composition of a third preferred embodiment of the invention consists essentially of, on the basis of the total weight of the composition, 50.0 to 97.9% by weight of the base oil (a); 1 to 25% by weight of the urea thickener (b); 0.5 to 5.0% by weight of the molybdenum disulfide (c); 0.5 to 15% by weight of the metal salt or overbasic metal salt (d); and 0.1 to 5% by weight of the molybdenum dithiocarbamate (f).

The grease composition of a fourth preferred embodiment of the invention consists essentially of, on the basis of the total weight of the composition, 63.0 to 91.5% by weight of the base oil (a); 5 to 20% by weight of the urea thickener (b); 2 to 4% by weight of the molybdenum disulfide (c); 1 to 10% by weight of the metal salt or overbasic metal salt (d); and 0.5 to 3% by weight of the molybdenum dithiocarbamate (f).

The grease composition of a fifth preferred embodiment of the invention consists essentially of, on the basis of the total weight of the composition, 60.0 to 91.4% by weight of the base oil (a); 5 to 20% by weight of the urea thickener (b); 2 to 4% by weight of the molybdenum disulfide (c); 1 to 10% by weight of the metal salt or overbasic metal salt (d) wherein the metal salt or the overbasic metal salt is selected from the group consisting of salts of magnesium, barium, sodium, potassium, lead, zinc, and aluminum; 0.1 to 3% by weight of the extreme pressure agent selected from the group consisting of a metal-free sulfur-phosphorus extreme pressure agent and molybdenum dithiophosphate (e); and 0.5 to 3% by weight of the molybdenum dithiocarbamate (f).

If the amount of the urea thickener (b) is less than 1% by weight, the thickening effect thereof tends to become too low to convert the composition into a grease, while if it exceeds 25% by weight, the resulting composition tends to become too hard to ensure the desired effects of the present invention. Moreover, it becomes difficult to obtain the desired effects of the present invention if the amount of the molybdenum disulfide (c) is less than 0.5% by weight, the amount of the metal salt or overbasic metal salt (d) is less than 0.5% by weight, the amount of the extreme pressure agent (e) is less than 0.1% by weight, or the amount of the molybdenum dithiocarbamate (f) is less than 0.1% by weight. On the other hand, if the amount of the molybdenum disulfide (c) is more than 5% by weight, the amount of the metal salt or overbasic metal salt (d) is more than 15% by weight, the amount of the extreme pressure agent (e) is more than 3% by weight, or the amount of the molybdenum dithiocarbamate (f) is more than 5% by weight, any further improvement in the effects cannot be expected and these components rather inversely affect the pitting-inhibitory effect of the present invention.

The present invention will hereunder be described in more detail with reference to the following non-limitative working Examples and Comparative Examples.

EXAMPLES 1 to 11 AND COMPARATIVE EXAMPLES 1 and 2

There were added, to a container, 4100 g of a base oil and 1012 g of diphenylmethane-4,4'-diisocyanate and the mixture was heated to a temperature between 70° and 80° C. To another container, there were added 4100 g of a base oil, 563 g of cyclohexylamine and 225 g of aniline followed by heating at a temperature between 7° and 80° C. and addition thereof to the foregoing container. The mixture was then reacted for 30 minutes with sufficient stirring, the temperature of the reaction system was raised up to 160° C. with stirring and the reaction system was allowed to cool to give a base urea grease. To the base grease, there were added the following additives listed in Table 1 in amounts likewise listed in Table 1 and an optional and additional amount of the base oil and the penetration of the resulting mixture was adjusted to the No. 1 grade by a three-stage roll mill.

EXAMPLES 12 and 13

There were added, to a container, 440 g of a base oil and 58.9 g of diphenylmethane-4,4'-diisocyanate and the mixture was heated to a temperature between 70° and 80° C. To another container, there were added 440 g of a base oil and 61.1 g of octylamine followed by heating at a temperature between 70° and 80° C. and addition thereof to the fore-mentioned container. The mixture was then reacted for 30 minutes with sufficient stirring, the temperature of the reaction system was raised up to 160° C. with stirring and the reaction system was allowed to cool to give a base aliphatic amine urea grease. To the base grease, there were added the following additives listed in Table 1 in amounts likewise listed in Table 1 and an optional and additional amount of the base oil and the penetration of the resulting mixture was adjusted to the No. 1 grade by a three-stage roll mill.

In all of the abovementioned Examples and Comparative Examples, a mineral oil having the following properties was used as the base oil.

| | | |
|---|---|---|
| Viscosity: | at 40° C. | 130 $mm^2/s$ |
| | at 100° C. | 14 $mm^2/s$ |
| Viscosity Index: | 106 | |

Moreover, a commercially available lithium grease containing molybdenum disulfide, a sulfur-phosphorus extreme pressure agent and a lead naphthenate was used as the grease of Comparative Example 3.

Physical properties of these greases were evaluated according to the methods detailed below. The results thus obtained are also summarized in Table 1

[Penetration] According to ISO 2137.

[Dropping point] According to ISO 2176.

[SRV Test]

Test Piece:

ball: diameter 10 mm (SUJ-2)

cylindrical plate: diameter 24 mm ×7.85 mm (SUJ-2)

Conditions for Evaluation:

Load: 300 N

Frequency: 15 Hz

Amplitude: 1000μm

Time: 10 min

Test Temperature: 150° C.

Items evaluated:

Maximum coefficient of friction

Averaged diameter of wear scar observed on balls (mm)

Maximum depth of wear observed on plates (μm)

[Durability Test on Bench Using Real Joints]

The greases were inspected, under the following conditions, for the occurrence of pitting by a durability test on a bench using real joints.

Test Conditions:

Number of Revolutions: 200 rpm

Torque: 785N.m

Angle of Joint: 7° C.

Operation Time: 100 hours

Type of Joint Used: Birfield Joint Cross Groove Joint

Item evaluated: Occurrence of pitting at each part after operation.

TABLE 1

| | Example | | | | | | | | |
|---|---|---|---|---|---|---|---|---|---|
| | 1 | 2 | 3 | 4 | 5 | 6 | 7 | 8 | 9 |
| Components | | | | | | | | | |
| 1) Diurea Grease ① | 94.0 | 94.0 | 94.0 | 94.0 | 94.0 | 92.0 | 94.0 | 94.5 | 94.5 |
| 2) Diurea Grease ② | — | — | — | — | — | — | — | — | — |

TABLE 1-continued

| | | | | | | | | | |
|---|---|---|---|---|---|---|---|---|---|
| 3) Molybdenum Disulfide | 3.0 | 3.0 | 3.0 | 3.0 | 3.0 | 3.0 | 3.0 | 3.0 | 3.0 |
| 4) Ca salt of oxidized wax | 3.0 | — | — | — | — | — | — | 2.0 | 2.0 |
| 5) Calcium petroleum sulfonate | — | 3.0 | — | — | — | — | — | — | — |
| 6) Calcium salicylate | — | — | 3.0 | — | — | — | — | — | — |
| 7) Calcium phenate | — | — | — | 3.0 | — | — | — | — | — |
| 8) Overbasic calcium sulfonate ① | — | — | — | — | 3.0 | 5.0 | — | — | — |
| 9) Overbasic calcium sulfonate ② | — | — | — | — | — | — | 3.0 | — | — |
| 10) S-P Extreme pressure agent | — | — | — | — | — | — | — | 0.5 | — |
| 11) Molybdenum dithiophosphate | — | — | — | — | — | — | — | — | 0.5 |
| 12) Molybdenum dithiocarbamate ① | — | — | — | — | — | — | — | — | — |
| 13) Molybdenum dithiocarbamate ① | — | — | — | — | — | — | — | — | — |
| Evaluation Test | | | | | | | | | |
| 14) Penetration (60 W) | 329 | 333 | 331 | 334 | 328 | 329 | 332 | 333 | 336 |
| 15) Dropping Point (°C.) | 260< | 260< | 260< | 260< | 260< | 260< | 260< | 260< | 260< |
| 16) SRV Test Max. Coeff. of Friction | 0.06 | 0.06 | 0.07 | 0.06 | 0.07 | 0.06 | 0.07 | 0.07 | 0.06 |
| 17) Wear Scar Diameter (mm) | 0.45 | 0.46 | 0.46 | 0.47 | 0.46 | 0.44 | 0.47 | 0.45 | 0.46 |
| 18) Wear Depth (μm) | 0.3 | 0.3 | 0.3 | 0.2 | 0.3 | 0.3 | 0.4 | 0.3 | 0.3 |
| Durability Test | | | | | | | | | |
| 19) Birfield Joint | ○ | ○ | ○ | ○ | ○ | ○ | ○ | ○ | ○ |
| 20) Cross Groove Joint | ○ | ○ | ○ | ○ | ○ | ○ | ○ | ○ | ○ |

| | Example | | | | Comparative Example | | |
|---|---|---|---|---|---|---|---|
| | 10 | 11 | 12 | 13 | 1 | 2 | 3 |
| Components | | | | | | | |
| 1) Diurea Grease ① | 93.5 | 93.0 | — | — | 97.0 | 97.0 | |
| 2) Diurea Grease ② | — | — | 94.0 | 93.0 | — | — | |
| 3) Molybdenum Disulfide | 3.0 | 3.0 | 3.0 | 3.0 | 3.0 | — | |
| 4) Ca salt of oxidized wax | — | — | — | — | — | — | |
| 5) Calcium petroleum sulfonate | — | — | — | — | — | — | |
| 6) Calcium salicylate | — | — | — | — | — | — | |
| 7) Calcium phenate | — | — | — | — | — | — | |
| 8) Overbasic calcium sulfonate ① | 3.0 | 3.0 | 3.0 | 3.0 | — | 3.0 | |
| 9) Overbasic calcium sulfonate ② | — | — | — | — | — | — | |
| 10) S-P Extreme pressure agent | — | — | — | — | — | — | |
| 11) Molybdenum dithiophosphate | — | — | — | — | — | — | |
| 12) Molybdenum dithiocarbamate ① | 0.5 | — | — | — | — | — | |
| 13) Molybdenum dithiocarbamate ① | — | 1.0 | — | 1.0 | — | — | |
| Evaluation Test | | | | | | | |
| 14) Penetration (60 W) | 324 | 328 | 322 | 324 | 315 | 332 | 280 |
| 15) Dropping Point (°C.) | 260< | 260< | 236 | 242 | 260< | 260< | 190 |
| 16) SRV Test Max. Coeff. of Friction | 0.06 | 0.06 | 0.08 | 0.07 | 0.13 | 0.12 | 0.20 |
| 17) Wear Scar Diameter (mm) | 0.47 | 0.46 | 0.49 | 0.47 | 0.51 | 0.54 | 0.53 |
| 18) Wear Depth (μm) | 0.4 | 0.3 | 0.5 | 0.4 | 3.0 | 1.8 | 3.0 |
| Durability Test | | | | | | | |
| 19) Birfield Joint | ○ | ○ | ○ | ○ | x | x | x |
| 20) Cross Groove Joint | ○ | ○ | ○ | ○ | x | x | x |

1) Diurea grease using a diurea compound wherein cyclohexyl amine and an iline are used as a monoamine
2) Diurea grease using a diurea compound wherein octyl amine is used as a monoamine
3) Molybdenum disulfide available from Climax Molybdenum Company under the trade name of Molysulfide; average particle size: 0.7 μm
4) Calcium salt of oxidized wax available from Alox Corporation under the trade name of Alox 165
5) Calcium salt of petroleum sulfonate available from Matsumura Petroleum Laboratory Co., Ltd. under the trade name of Sulfol Ca-45
6) Calcium salicylate available from Osca Chemical Co., Ltd. under the trade name of OSCA423
7) Calcium phenate available from Oronite Japan Co., Ltd. under the trade name of OLOA 218A
8) Overbasic calcium sulfonate ① available from Lubrizol Japan under the trade name of Lubrizol 5283
9) Overbasic calcium sulfonate ② available from Witco Corporation under the trade name of Bryton C-400C
10) Sulfur-phosphorus extreme pressure agent available from Mobil Chemical under the trade name of Mobilad G-305
11) Molybdenum dithiophosphate available from R. T. Vanderbilt under the trade name of Molyvan L
12) Molybdenum dithiocarbamate ① available from R. T. Vanderbilt under the trade name of Molyvan A
13) Molybdenum dithiocarbamate ② available from R. T. Vanderbilt under the trade name of Molyvan 822
14) Penetration according to ISO 2137
15) Dropping point according to ISO 2176 (° C.)
16) Maximum coefficient of friction
17) Averaged diameter of wear scar observed on balls (mm)
18) Maximum depth of wear observed on plates (μm)
19) Durability test on bench using real joints Birfield Joint
20) Durability test on bench using real joints Cross Groove Joint In the durability test, these greases were evaluated according to the following criteria:

○: No pitting was observed;

X: Pitting was observed.

As has been discussed above in detail, the grease composition for constant velocity joints according to the present invention consists essentially of (a) a base oil; (b) an urea thickener; (c) molybdenum disulfide; (d) a specific metal salt or a specific overbasic metal salt; and optionally, (e) an extreme pressure agent selected from the group consisting of a metal-free sulfur-phosphorus extreme pressure agent and molybdenum dithiophosphate; or (f) molybdenum dithiocarbamate and thus exhibits excellent wear-resistant effect and an excellent pitting-inhibitory effect as is also apparent from the comparison of the results of Examples with those of Comparative Examples.

What is claimed is:

1. A grease composition for constant velocity joints consisting essentially of:

(a) a base oil;

(b) an urea thickener;

(c) molybdenum disulfide; and (d) a metal salt or an overbasic metal salt selected from the group consisting of metal salts of oxidized waxes, metal salts of petroleum sulfonates, metal salts of alkyl aryl sulfonates, metal salts of salicylate, metal salts of phenates, overbasic metal salts of oxidized waxes, overbasic metal salts of petroleum sulfonates, overbasic metal salts of alkyl aryl sulfonates, overbasic metal salts of salicylate, and overbasic metal salts of phenates.

2. The grease composition for constant velocity joints of claim 1 wherein the grease composition further comprises (e) an extreme pressure agent selected from the group consisting of a metal-free sulfur-phosphorus extreme pressure agent and molybdenum dithiophosphate.

3. The grease composition for constant velocity joints of claim 1 wherein the grease composition further comprises (f) molybdenum dithiocarbamate.

4. The grease composition for constant velocity joints of claim 1 wherein the metal salt or the overbasic metal salt is selected from the group consisting of salts of calcium, magnesium, barium, sodium, potassium, lead, zinc, and aluminum.

5. The grease composition for constant velocity joints of claim 1 wherein the metal salt or the overbasic metal salt is a calcium salt or an overbasic calcium salt.

6. The grease composition for constant velocity joints of claim 1 wherein the metal salt or the overbasic metal salt is a sodium salt or an overbasic sodium salt.

7. The grease composition for constant velocity joints of claim 1 wherein the grease composition consists essentially of, on the basis of the total weight of the composition, 55.0 to 98.0% by weight of the base oil (a); 1 to 25% by weight of the urea thickener (b); 0.5 to 5.0% by weight of the molybdenum disulfide (c); and 0.5 to 15% by weight of the metal salt or overbasic metal salt (d).

8. The grease composition for constant velocity joints of claim 2 wherein the grease composition consists essentially of, on the basis of the total weight of the composition, 52.0 to 97.9% by weight of the base oil (a); 1 to 25% by weight of the urea thickener (b); 0.5 to 5.0% by weight of the molybdenum disulfide (c); 0.5 to 15% by weight of the metal salt or overbasic metal salt (d); and 0.1 to 3% by weight of the extreme pressure agent selected from the group consisting of a metal-free sulfur-phosphorus extreme pressure agent and molybdenum dithiophosphate (e).

9. The grease composition for constant velocity joints of claim 2 wherein the extreme pressure agent is a metal-free sulfur-phosphorus extreme pressure agent which has a sulfur content ranging from 15 to 35% by weight and a phosphorus content ranging from 0.5 to 3% by weight.

10. The grease composition for constant velocity joints of claim 3 wherein the grease composition consists essentially of, on the basis of the total weight of the composition, 50.0 to 97.9% by weight of the base oil (a); 1 to 25% by weight of the urea thickener (b); 0.5 to 5.0% by weight of the molybdenum disulfide (c); 0.5 to 15% by weight of the metal salt or overbasic metal salt (d); and 0.1 to 5% by weight of the molybdenum dithiocarbamate (f).

11. A grease composition for constant velocity joints consisting essentially of:

(a) a base oil;

(b) an urea thickener;

(c) molybdenum disulfide;

(d) a metal salt or an overbasic metal salt selected from the group consisting of metal salts of oxidized waxes, metal salts of petroleum sulfonates, metal salts of alkyl aryl sulfonates, metal salts of salicylate, metal salts of phenates, overbasic metal salts of oxidized waxes, overbasic metal salts of petroleum sulfonates, overbasic metal salts of alkyl aryl sulfonates, overbasic metal salts of salicylate, and overbasic metal salts of phenates; wherein the metal salt or the overbasic metal salt is selected from the group consisting of salts of magnesium, barium, sodium, potassium, lead, zinc, and aluminum;

(e) an extreme pressure agent selected from the group consisting of a metal-free sulfur-phosphorus extreme pressure agent and molybdenum dithiophosphate; and (f) molybdenum dithiocarbamate.

12. The grease composition for constant velocity joints of claim 11 wherein the grease composition consists essentially of, on the basis of the total weight of the composition, 60.0 to 91.4% by weight of the base oil (a); 5 to 20% by weight of the urea thickener (b); 2 to 4% by weight of the molybdenum disulfide (c); 1 to 10% by weight of the metal salt or overbasic metal salt (d); 0.1 to 3% by weight of the extreme pressure agent selected from the group consisting of a metal-free sulfur-phosphorus extreme pressure agent and molybdenum dithiophosphate (e); and 0.5 to 3% by weight of the molybdenum dithiocarbamate (f).

* * * * *